US008480294B2

(12) United States Patent
Helfer et al.

(10) Patent No.: US 8,480,294 B2
(45) Date of Patent: Jul. 9, 2013

(54) BALANCE SPRING WITH FIXED CENTRE OF MASS

(75) Inventors: Jean-Luc Helfer, Bienne (CH); Kaspar Trumpy, Soleure (CH)

(73) Assignee: Montres Breguet S.A., L'Abbaye (CH)

( * ) Notice: Subject to any disclaimer, the term of this patent is extended or adjusted under 35 U.S.C. 154(b) by 104 days.

(21) Appl. No.: 13/177,845

(22) Filed: Jul. 7, 2011

(65) Prior Publication Data

US 2012/0008467 A1 Jan. 12, 2012

(30) Foreign Application Priority Data

Jul. 9, 2010 (EP) ..... 10169068

(51) Int. Cl.
*G04B 17/04* (2006.01)

(52) U.S. Cl.
USPC ..... 368/175; 368/177

(58) Field of Classification Search
USPC ..... 368/171, 175, 177–178
See application file for complete search history.

(56) References Cited

U.S. PATENT DOCUMENTS

| | | | | | |
|---|---|---|---|---|---|
| 30,247 | A * | 10/1860 | Reed | ..... | 368/175 |
| 109,826 | A * | 12/1870 | Kline | ..... | 368/175 |
| 570,394 | A * | 10/1896 | Griscom | ..... | 368/175 |
| 2,632,292 | A * | 3/1953 | Amend, Jr. | ..... | 368/164 |
| 8,002,460 | B2 * | 8/2011 | Daout et al. | ..... | 368/175 |
| 8,215,828 | B2 * | 7/2012 | Zaugg et al. | ..... | 368/175 |
| 8,296,953 | B2 * | 10/2012 | Buhler et al. | ..... | 29/896.31 |
| 2009/0236782 | A1 | 9/2009 | Buhler et al. | | |
| 2009/0245030 | A1 | 10/2009 | Buhler et al. | | |
| 2010/0027382 | A1 * | 2/2010 | Daout et al. | ..... | 368/175 |

FOREIGN PATENT DOCUMENTS

| | | |
|---|---|---|
| EP | 2 105 807 A1 | 9/2009 |
| EP | 2 184 652 A1 | 5/2010 |
| EP | 2 196 867 A1 | 6/2010 |
| EP | 2 104 006 B1 | 7/2010 |

OTHER PUBLICATIONS

European Search Report issued Jan. 5, 2011, in European Application No. 10169068.3, filed Jul. 9, 2010 (with English Translation).

* cited by examiner

*Primary Examiner* — Sean Kayes
(74) *Attorney, Agent, or Firm* — Oblon, Spivak, McClelland, Maier & Neustadt, L.L.P.

(57) ABSTRACT

The invention relates to a balance spring (1, 1') including a first hairspring (3, 3') the curve of which extends in a first plane, a second hairspring (5, 5') the curve of which extends in a second plane parallel to the first plane, an attachment member (4, 4') securing one end of the curve of the first hairspring (3, 3') to one end of the curve of the second hairspring (5, 5') so as to form a dual balance spring (1, 1') in series. According to the invention, the curve of the first hairspring (3, 3') and the curve of the second hairspring (5, 5') each include a continuously variable pitch and are symmetrical relative to a straight line (A) parallel to the first and second planes and passing through the median plane of projection of the attachment member (4, 4') and in that each curve respects the relations.

$$P_x^{(0)}=0 \text{ and } P_y^{(1)}=2P_y^{(0)}$$

in order to reduce displacements of the centre of mass thereof during contraction and expansion.

The invention concerns the field of sprung balance resonators.

11 Claims, 8 Drawing Sheets

BALANCE SPRING WITH FIXED CENTRE OF MASS

This application claims priority from European Patent Application No. 10169068.3 filed Jul. 9, 2010, the entire disclosure of which is incorporated herein by reference.

FIELD OF THE INVENTION

The invention relates to a balance spring used to form a sprung balance resonator whose curvature allows development with a substantially fixed centre of mass.

BACKGROUND OF THE INVENTION

EP Patent Nos. 2 184 652, 2 196 867 and 2 105 807 explain how to fabricate balance springs with curve elevation made of micro-machinable materials respectively using three parts, two parts or a single part. These documents are incorporated herein by reference.

It is known to apply the Phillips criteria to determine the theoretical curvature of a terminal curve. However, the Phillips criteria are actually an approximation which is not necessarily satisfactory if an even lower variation in rate is required.

SUMMARY OF THE INVENTION

It is an object of the present invention to overcome all of part of aforecited drawbacks by proposing a balance spring that respects predetermined conditions able to reduce the displacement of the centre of mass of the balance spring in contraction and expansion.

The invention therefore relates to a balance spring including a first hairspring, the curve of which extends in a first plane, a second hairspring, the curve of which extends in a second plane parallel to the first plane, an attachment member securing one end of the curve of the first hairspring to one end of the second hairspring so as to form a dual balance spring in series, characterized in that the curve of the first hairspring and the curve of the second hairspring each have a continuously variable pitch and are symmetrical relative to a straight line parallel to the first and second planes passing through the median plane of projection of the attachment member and in that each curve respects the relation:

$$P_x^{(0)}=0 \text{ and } P_y^{(1)}=2P_y^{(0)}$$

in order to reduce displacements of the centre of mass thereof during contraction and expansion.

In accordance with other advantageous features of the invention:

each curve also respects the following relation:

$$P_x^{(2)}=3P_x^{(1)};$$

and, possibly:

$$P_y^{(3)}=4P_y^{(2)}-8P_y^{(0)};$$

and, possibly:

$$P_y^{(5)}=6P_y^{(4)}-40P_y^{(2)}+96P_y^{(0)};$$

and, possibly:

$$P_y^{(5)}=6P_y^{(4)}-40P_y^{(2)}+96P_y^{(0)};$$

and, possibly:

$$P_x^{(6)}=7P_x^{(5)}-70P_x^{(3)}+336P_x^{(1)}.$$

each hairspring includes at least one counterweight to compensate for the unbalance formed by the mass of the attachment member;

the balance spring is formed from silicon;

the balance spring includes at least one part coated with silicon dioxide so as to limit the sensitivity thereof to temperature variations and mechanical shocks.

Moreover, the invention relates to a resonator for a timepiece including an inertia block, such as, for example, a balance characterized in that the inertia block cooperates with a balance spring according to any of the preceding variants.

BRIEF DESCRIPTION OF THE DRAWINGS

Other features and advantages will appear clearly from the following description, given by way of non-limiting indication, with reference to the annexed drawings, in which.

DETAILED DESCRIPTION OF PREFERRED EMBODIMENTS

The rate variations of a mechanical watch relative to the theoretical frequency thereof are mainly due to the escapement and to the sprung balance resonator. Two types of rate variations can be differentiated, depending upon whether they are caused by the oscillation amplitude of the balance or by the position of the timepiece movement. This is why, for anisochronism tests, a timepiece movement is tested in six positions: 2 horizontal (dial facing up and down) and 4 vertical positions (stem rotated through 90° from an upward facing position). From the six distinct curves thereby obtained, the maximum variation between said curves, also called the "antinode" is determined, expressing the maximum rate variation of the movement in seconds per day ($s \cdot j^{-1}$).

The escapement induces a rate variation according to the amplitude of the balance which is difficult to regulate. Consequently, the balance spring is generally adapted so that the variation thereof according to the same amplitude is substantially opposite to that of the escapement. Moreover, the balance spring is adapted so that the variation thereof is minimal between the four vertical positions.

Attempts have been made to set out the necessary balance spring adaptations in mathematical terms in order to determine ideal curves by calculations. Geometrical conditions were set out notably by Messrs Phillips and Grossmann for designing a satisfactory balance spring, i.e. wherein the centre of mass of the balance spring remains on the balance staff. However, current conditions are rough approximations. Consequently, since very small displacements of the centre of mass can cause large rate variations, the rate variations obtained by following current geometrical conditions are often disappointing.

This is why, advantageously according to the invention, new conditions are set out below for obtaining better rate variation results than with current geometrical conditions, particularly those decreed by Messrs Phillips and Grossmann.

<<An nth order balance spring moment>>, $\vec{P}^{(n)}$, is defined by the following formula:

$$\vec{P}^{(n)} = \frac{n+1}{L^{n+1}} \int_0^L ds \cdot s^n \cdot \vec{x}(s) \tag{1}$$

where:

L is the length of the balance spring;

$s^n$ represents the curvilinear abscissa along the balance spring to the power of n;

$\vec{x}(s)$ is the parameterization of the balance spring by the curvilinear abscissa thereof.

Thus, in order to obtain a fixed centre of mass, for each nth order, the balance spring moment $\vec{P}^{(n)}$ must be zero. Since it is not possible to calculate all of the orders as there is an infinite number of them, the larger the number of orders where the zero relation (1) is respected, the smaller the centre of mass displacement quantity will be.

Figure 1:
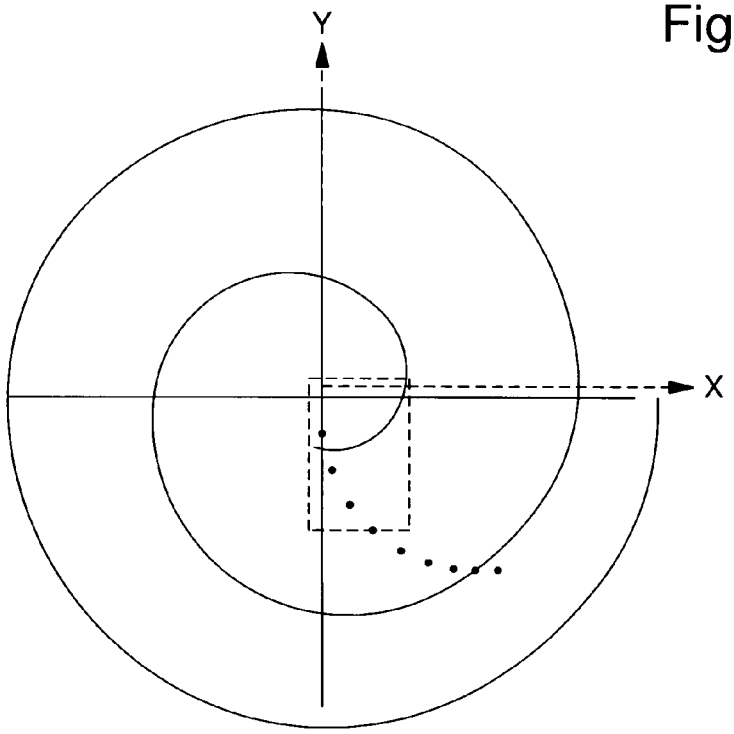
FIGS. 1 and 2 are diagrams explaining the coherent reasoning.

In the example illustrated in FIG. 1, eight order moments of the balance spring are represented by dots which define an "ideal" theoretical curve, via parametrization using a polynomial including at least as many coefficients as orders (in our case at least eight).

Figure 9:
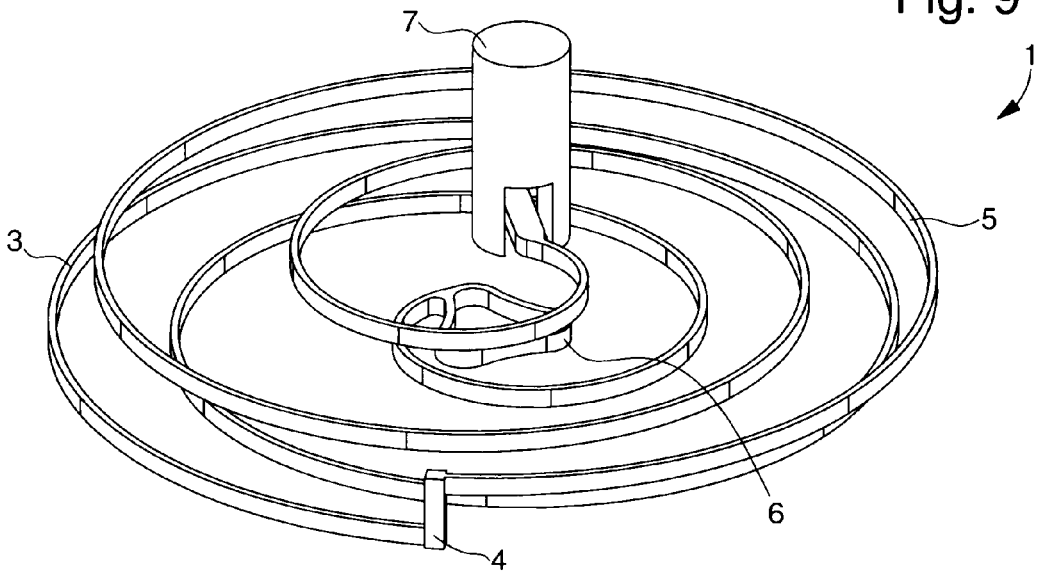
FIGS. 9 and 10 are diagrams of a balance spring according to the invention.
Figure 10:
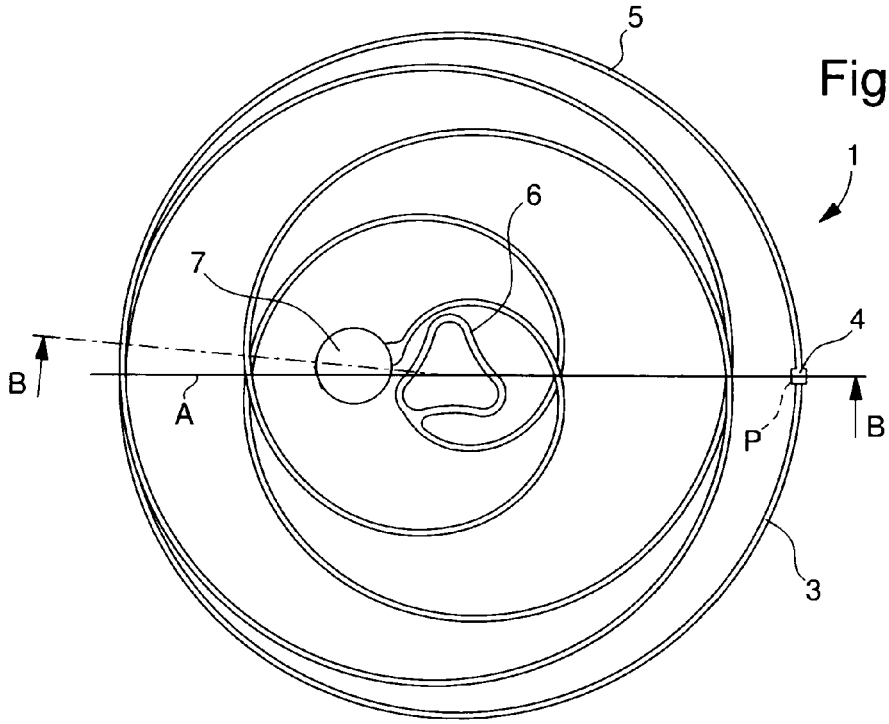
Figure 11:
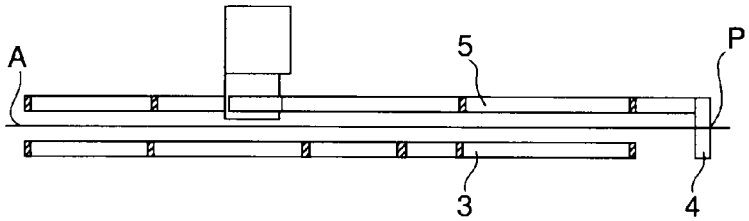
FIG. 11 is a broken cross-section diagram along axis B-B.

In order to apply these zero moment conditions of the balance spring, we start with a balance spring of the type shown in FIGS. 9 and 10, i.e. a balance spring 1 including a first hairspring 3, the curve of which extends in a first plane, and a second hairspring 5, the curve of which extends in a second plane parallel to the first plane. Each end of hairspring 3, 5 is secured by an attachment member 4 so as to form a dual balance spring in series.

As explained above, it is possible to fabricate this type of balance spring using the methods explained in EP Patent Nos EP 2 184 652, EP 2 196 867 et EP 2 105 807 from micromachinable materials such as silicon, respectively using three parts, two parts or a single part. Of course, this type of balance spring may be fabricated from other methods and/or other materials.

In order to simplify the calculations, the curve of the first hairspring 3 and the curve of the second hairspring 5 preferably each include a continuously variable pitch and are symmetrical relative to a straight line A parallel to the first and second planes passing through the centres of the median plane P of projection of attachment member 4 and the balance staff.

Consequently, by way of example, for each hairspring 3, 5, the first seven orders must respect the following relations:

$$P_x^{(0)}=0 \tag{2}$$

$$P_y^{(1)}=2P_y^{(0)} \tag{3}$$

$$P_x^{(2)}=3P_x^{(1)} \tag{4}$$

$$P_y^{(3)}=4P_y^{(2)}-8P_y^{(0)} \tag{5}$$

$$P_x^{(4)}=5P_x^{(3)}-20P_x^{(1)} \tag{6}$$

$$P_y^{(5)}=6P_y^{(4)}-40P_y^{(2)}+96P_y^{(0)} \tag{7}$$

$$P_x^{(6)}=7P_x^{(5)}-70P_x^{(3)}+336P_x^{(1)} \tag{8}$$

Figure 2:
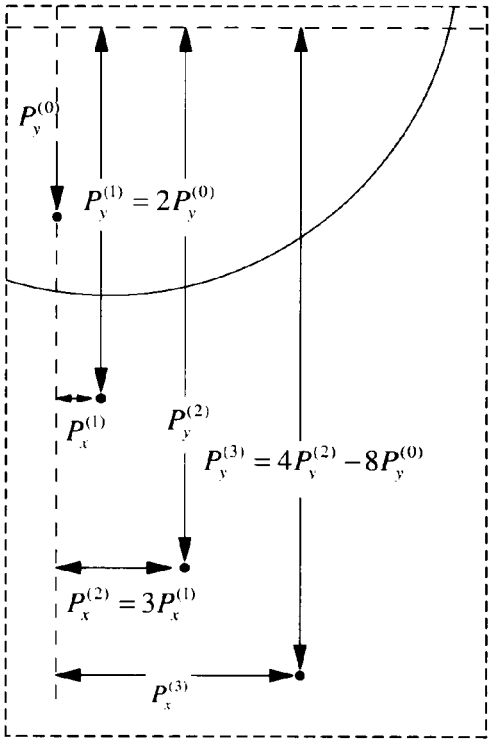
Figure 3:
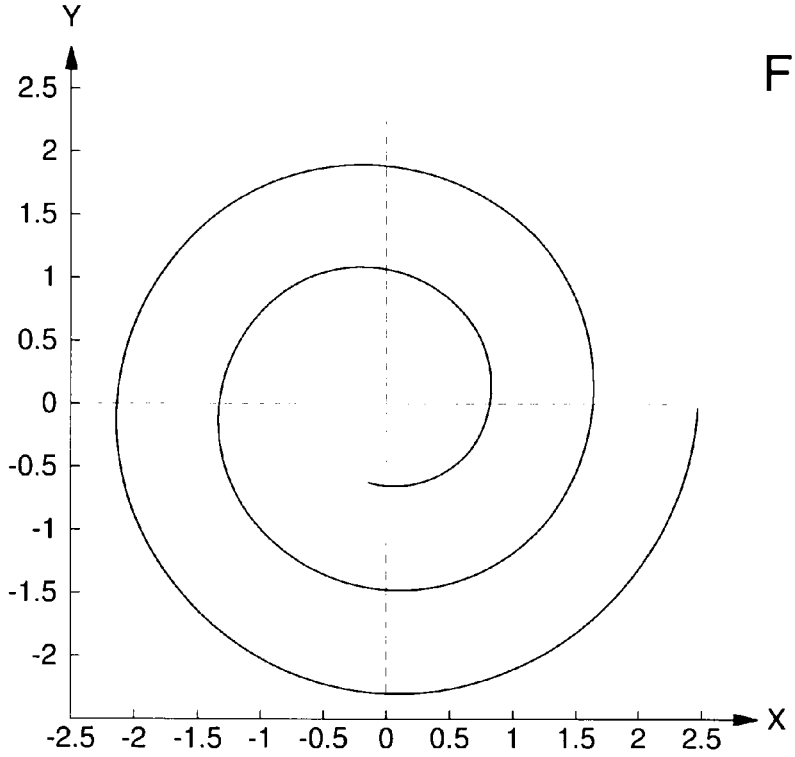
FIGS. 3 to 5 are calculation examples of curves with 2.3 coils respectively respecting up to second, third and fourth order moments equations.

As explained above, the higher the number of relations (2)-(8) that are respected, the more limited the displacement of the centre of mass of the balance spring 1 will be. By way of comparison, the Phillips conditions are close to the relation (2), i.e. a first order approximation. An application of the relations (2)-(5) is shown in FIG. 2 which is a partial enlarged view of FIG. 1.

Using parametrization, as explained above, it is possible to define a large variety of hairspring curves depending upon the inertia selected for the balance, the material, the section and length of the balance spring, but also the coefficients of the parametrization polynomials. It is also possible to choose particular solutions for example limiting the number of orders and/or number of coils.

Figure 4:
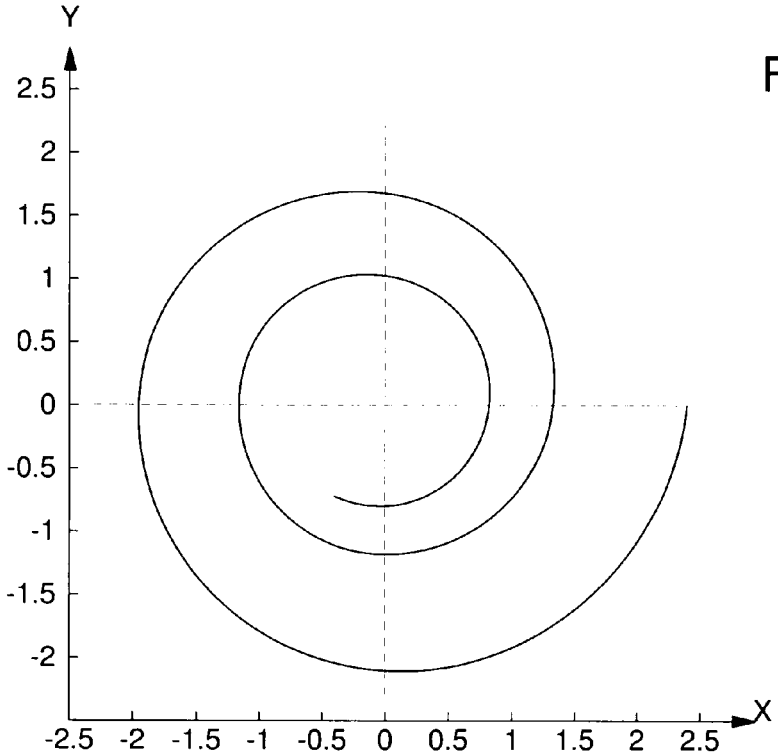
Figure 5:
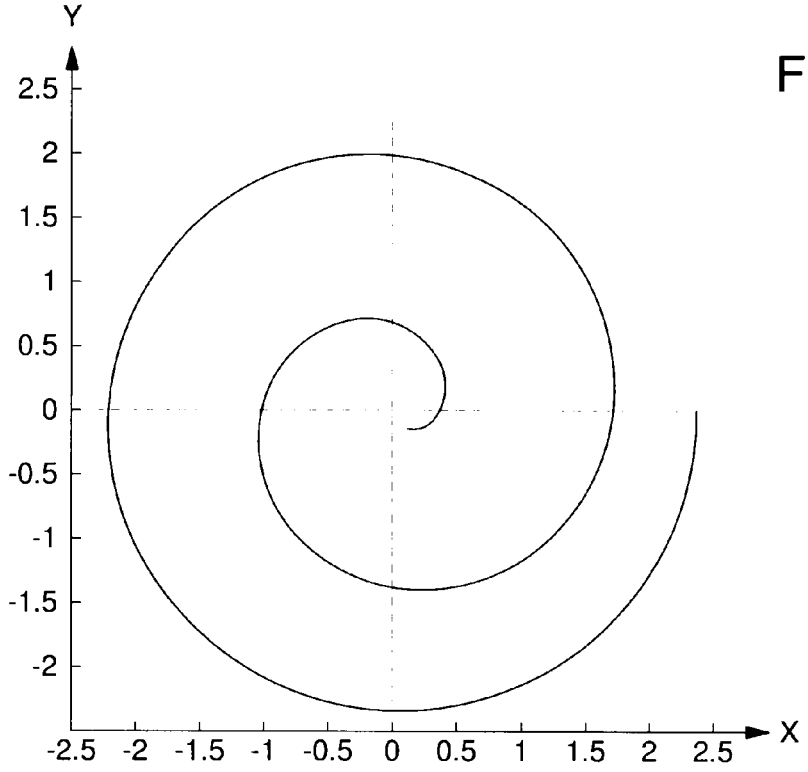
Figure 6:
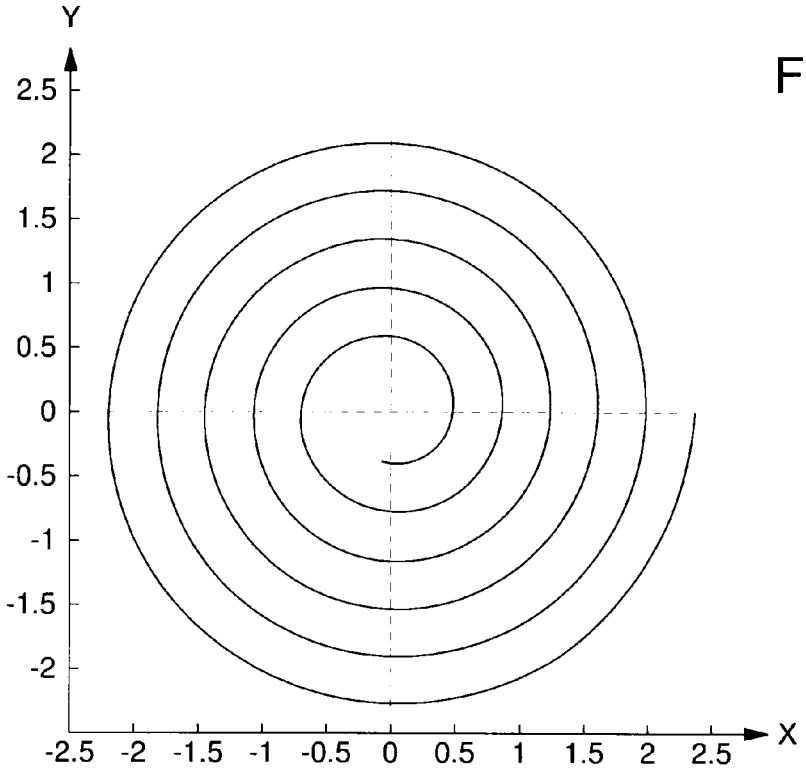
FIGS. 6 to 8 are calculation examples of curves with 5.3 coils respectively respecting up to second, third and fourth order moments equations.
Figure 7:
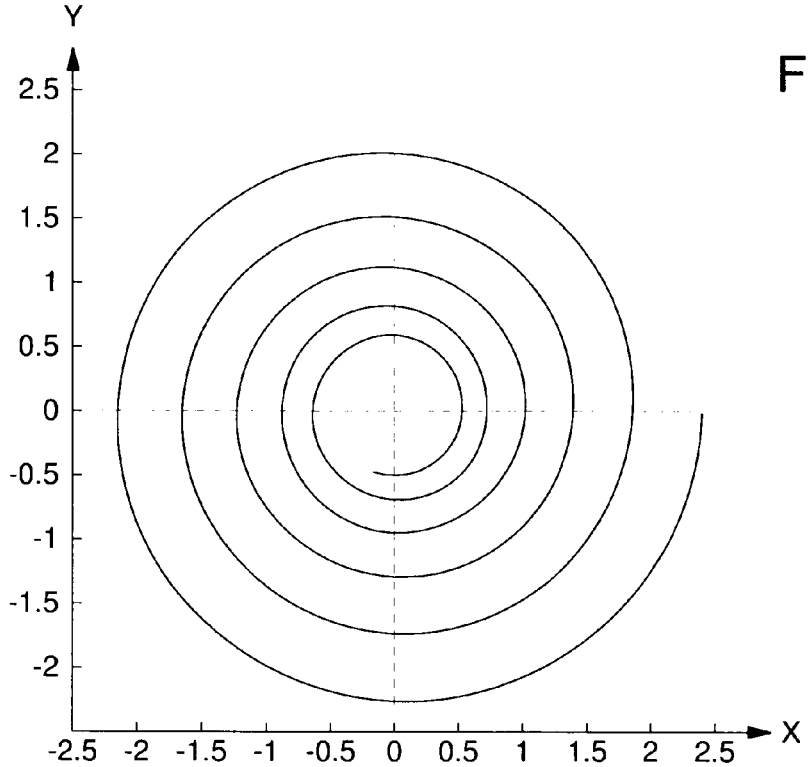
Figure 8:
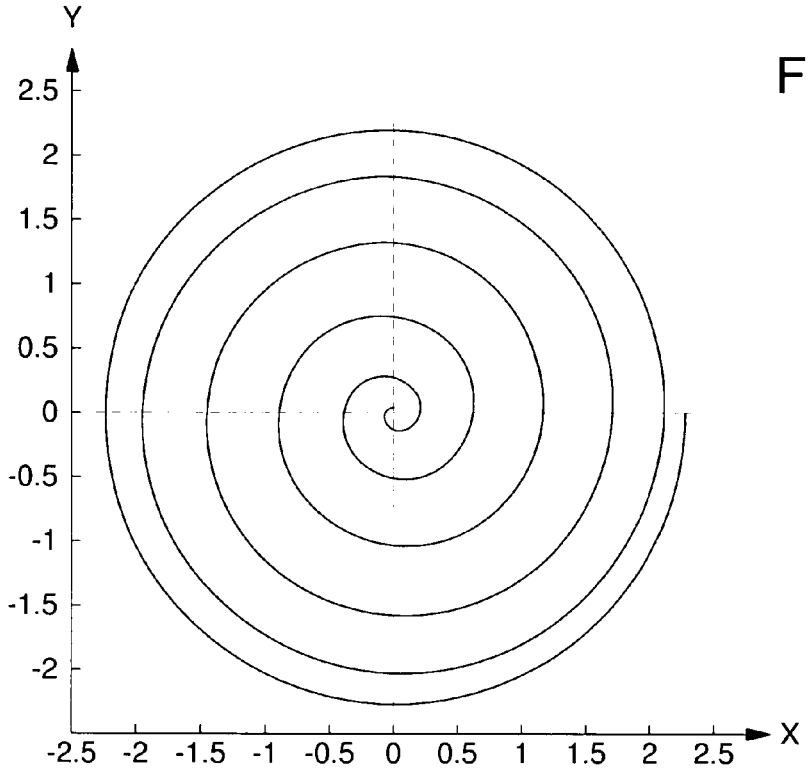

Possible curve simulations are shown in FIGS. 3 to 8. Thus, in order to form FIG. 3, the parametrization is limited to the relations (2) to (4) with a balance spring having 2.3 coils and a 2nd degree parametrization polynomial. FIG. 4 shows parametrization with a 3rd degree polynomial from the relations (2) to (5), again limiting the winding to 2.3 coils. Finally, FIG. 5 shows parametrization with a 4th degree polynomial from the relations (2) to (6), limiting the winding to 2.3 coils. FIGS. 6 to 8 show the same criteria respectively as FIGS. 3 to 5, but increasing the winding from 2.3 coils to 5.3 coils. It is seen that there is an infinite number of curve solutions respecting the relations (2)-(8) set out above.

Figure 12:
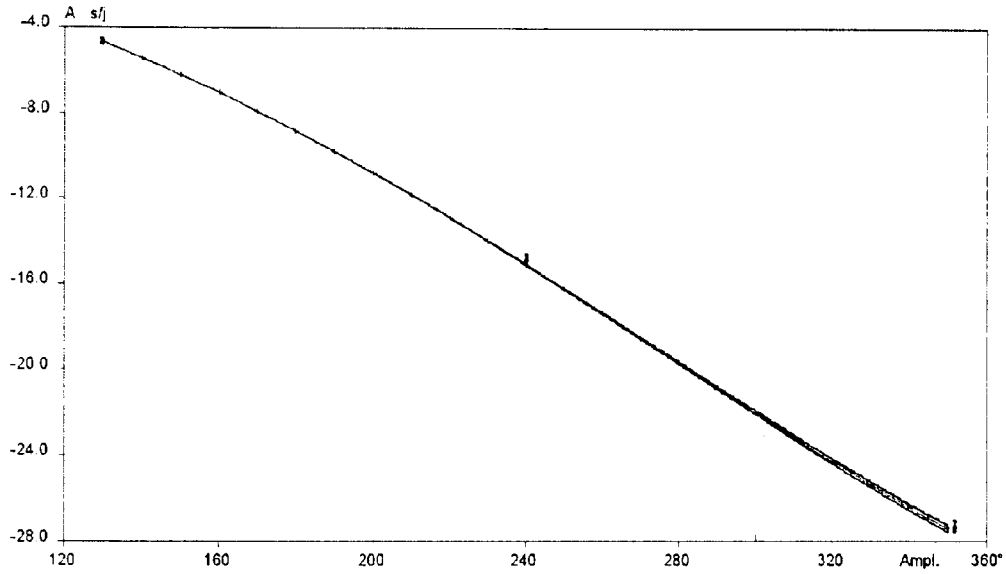
FIG. 12 is a simulation curve of the anisochronism of the balance spring according to FIGS. 9 and 10.

An anisochronism simulation was performed from the curvature shown in FIG. 5 forming balance spring 1 of FIGS. 9 and 10. Hairspring 3 includes a collet 6 in a single piece, and the end of hairspring 5, which is opposite attachment member 4, is secured to a stud 7. A balance inertia as high as 8 mg·cm$^2$ and a silicon balance spring having a section of 0.0267 mm×0.1 mm and a length L of 46 mm were chosen. The simulation result illustrated in FIG. 12 shows a very favourable result of 0.3 s·j$^{-1}$ at 300°. The advantage of these new conditions is therefore immediately clear, compared to the Phillips and Grossmann conditions with which adjustments still have to be made to decrease the "antinode".

Figure 13:
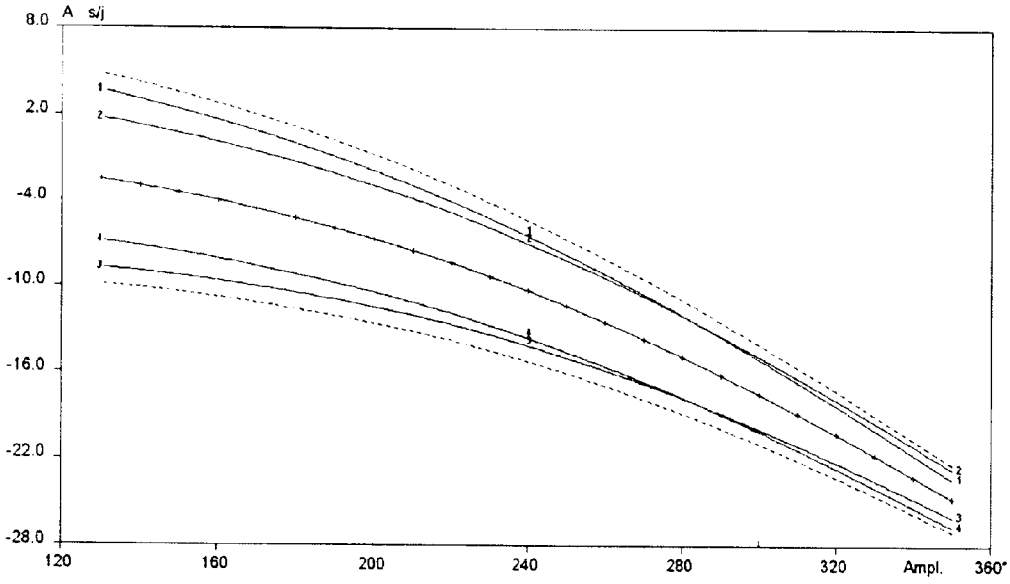
FIG. 13 is a simulation curve of the anisochronism of a balance spring wherein the mass of the attachment member is not negligible.

In the particular case where the balance spring is formed from three parts as explained in EP Patent No 2 184 652, the attachment member may become a not negligible mass and considerably amplify the anisochronism as seen in FIG. 13 in which the rate variation reaches 11.8 s·j$^{-1}$ at 200°.

Figure 14:
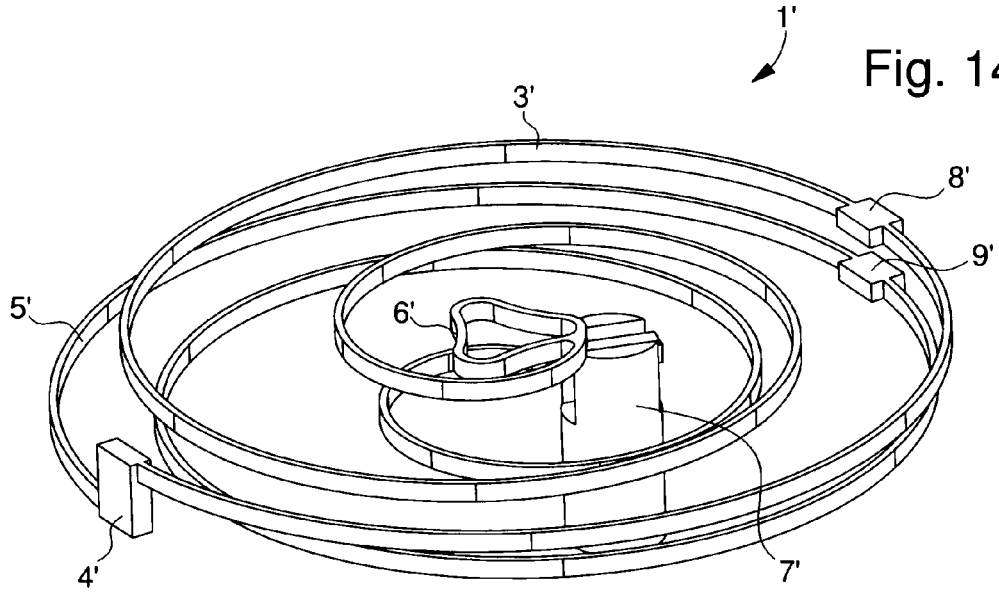
FIGS. 14 and 15 are diagrams of a balance spring according to the invention compensating for the mass of the attachment member.
Figure 15:
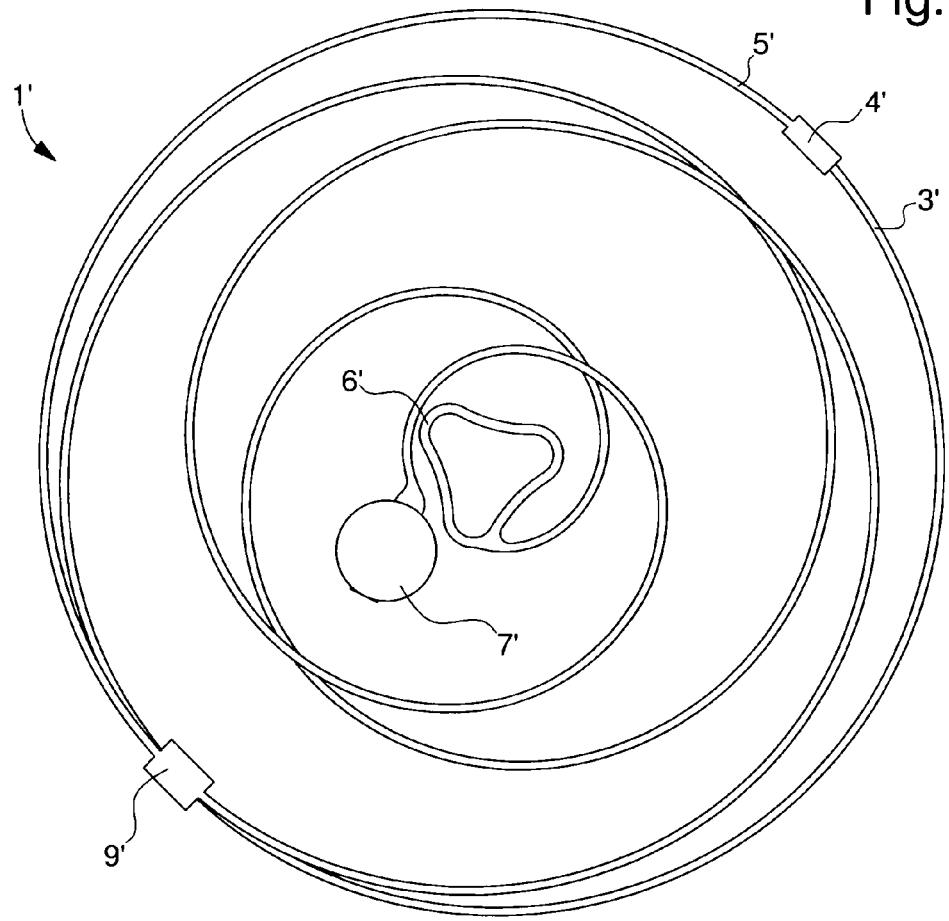
Figure 16:
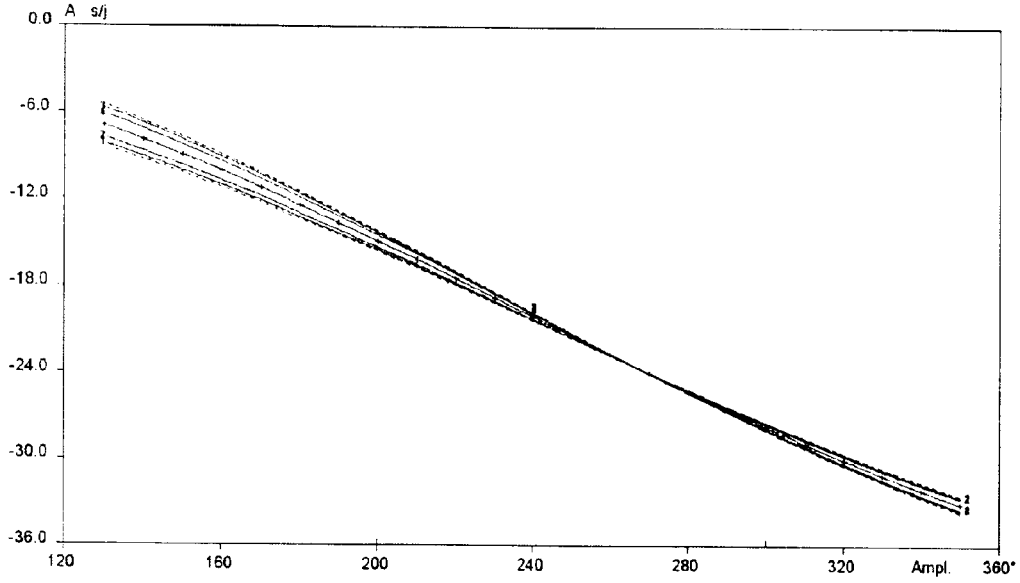
FIG. 16 is a simulation curve of the anisochronism of the balance spring of FIGS. 14 and 15.

In addition to respecting the highest number of relations (2)-(8), it also becomes necessary to compensate for the unbalance caused by the attachment member, i.e. to compensate for the mass of the attachment member relative to the distance thereof from the balance staff. Thus, preferably, the invention proposes cancelling out the unbalance of the attachment member by symmetrically adding an unbalance to the two hairsprings 3, 5. Preferably, the added unbalance comprises two substantially identical counterweights 8', 9' on each hairspring 3', 5', as illustrated in FIGS. 14 and 15. Preferably, the masses of counterweights 8' and 9' are substantially equal and the sum thereof is larger or smaller than that of attachment member 4', depending upon the difference in distance, on the one hand between attachment member 4' and the balance staff, and on the other hand, between counterweights 8', 9' and said balance staff. It is clear that if the distances are substantially the same, the masses of counterweights 8', 9' added together will form a substantially equivalent mass to that of attachment member 4'. The advantageously means that a favourable rate variation of 1.4 $s \cdot j^{-1}$ at 200° can be obtained with the same criteria as above, as illustrated in FIG. 16.

Of course, this invention is not limited to the illustrated example but is capable of various variants and alterations that will appear to those skilled in the art. In particular, other defining criteria can be provided, such as, for example, a limit of the ratio between the internal radius and external radius so that the ends of the hairsprings are not too close to the point of origin where the balance staff has to be located.

Moreover, when the balance spring is made of silicon, it may be at least partially coated in silicon dioxide in order to make it less sensitive to temperature variations and mechanical shocks.

Finally, each counterweight 8', 9' may be different. In particular, they may each be formed of two distinct masses, i.e. there could be four counterweights.

What is claimed is:

1. A balance spring comprising:

a first hairspring a curve of which extends in a first plane, a second hairspring a curve of which extends in a second plane parallel to the first plane, and an attachment member securing one end of the curve of the first hairspring to one end of the curve of the second hairspring so as to form a dual balance spring in series, wherein the curve of the first hairspring and the curve of the second hairspring each include a continuously variable pitch and are symmetrical relative to a straight line parallel to the first and second planes and passing through a median plane of projection of the attachment member and wherein each order n of a balance spring moment $\vec{P}^{(n)}$ is zero, where:

$$\vec{P}^{(n)} = \frac{n+1}{L^{n+1}} \int_0^L ds \cdot s^n \cdot \vec{x}(s)$$

where:

$\vec{P}^{(n)}$ in the $n^{th}$ order balance spring moment;

L is a length of the balance spring;

$s^n$ represents a curvilinear abscissa along the balance spring to the power of n;

$\vec{x}(s)$ is a parameterization of the balance spring by the curvilinear abscissa thereof.

2. The balance spring according to claim 1, wherein each curve respects the relations:

$$P_x^{(0)}=0 \text{ and } P_y^{(1)}=2P_y^{(0)}$$

where:

$\vec{P}_x^{(n)}$ is the $n^{th}$ order balance spring moment along an x axis; and $\vec{P}_y^{(n)}$ is the $n^{th}$ order balance spring moment along a y axis; in order to reduce displacements of the centre of mass thereof during contraction and expansion.

3. The balance spring according to claim 2, wherein each curve also respects the following relation:

$$P_x^{(2)}=3P_x^{(1)}$$

so as to further reduce the displacements of the centre of mass thereof during contraction and expansion.

4. The balance spring according to claim 3, wherein each curve also respects the following relation:

$$P_y^{(3)}=4P_y^{(2)}-8P_y^{(0)}$$

so as to further reduce the displacements of the centre of mass thereof during contraction and expansion.

5. The balance spring according to claim 4, wherein each curve also respects the following relation:

$$P_x^{(4)}=5P_x^{(3)}-20P_x^{(1)}$$

so as to further reduce the displacements of the centre of mass thereof during contraction and expansion.

6. The balance spring according to claim 5, wherein each curve also respects the following relation:

$$P_y^{(5)}=6P_y^{(4)}-40P_y^{(2)}+96P_y^{(0)}$$

so as to further reduce the displacements of the centre of mass thereof during contraction and expansion.

7. The balance spring according to claim 6, wherein each curve also respects the following relation:

$$P_x^{(6)}=7P_x^{(5)}-70P_x^{(3)}+336P_x^{(1)}$$

so as to further reduce the displacements of the centre of mass thereof during contraction and expansion.

8. The balance spring according to claim 1, wherein each hairspring includes at least one counterweight so as to compensate for the unbalance formed by the mass of the attachment member.

9. The balance spring according to claim 1, wherein it is formed from silicon.

10. The balance spring according to claim 9, wherein it includes at least one part coated with silicon dioxide so as to limit the sensitivity thereof to temperature variations and mechanical shocks.

11. A resonator for a timepiece including an inertia, wherein the inertia cooperates with a balance spring according to claim 1.

* * * * *